United States Patent [19]

Leachy

[11] 4,039,244

[45] Aug. 2, 1977

[54] BIMETALLIC ELECTRICAL CONNECTOR AND METHOD FOR MAKING THE SAME

[75] Inventor: Richard B. Leachy, Brookfield, Wis.

[73] Assignee: Coatings Inc., Milwaukee, Wis.

[21] Appl. No.: 675,644

[22] Filed: Apr. 9, 1976

[51] Int. Cl.[2] ..... H01R 11/08

[52] U.S. Cl. ..... 339/275 T; 339/278 C

[58] Field of Search ..... 339/272, 275, 276, 278

[56] References Cited

U.S. PATENT DOCUMENTS

| | | | |
|---|---|---|---|
| 3,768,065 | 10/1973 | Zemels | 339/272 R |
| 3,876,280 | 4/1975 | Jones | 339/276 T |

*Primary Examiner*—Joseph H. McGlynn

*Attorney, Agent, or Firm*—James E. Nilles; Thomas F. Kirby

[57] ABSTRACT

A one-piece bimetallic electrical connector comprises a cylindrical aluminum portion having a neck of reduced diameter extending therefrom and a cylindrical copper portion welded to the neck in a solid state bond. A wire receiving opening extends axially inwardly from the free end of the aluminum portion and electrical connection means, such as a threaded hole, are formed near the free end of the copper portion. Internal tool engaging recess means are provided within the opening in the aluminum portion for tool engagement purposes during welding and for accurately indexing the connector during other subsequent manufacturing operations such as machining and drilling of the threaded hole. External bosses are provided on the exterior of the aluminum portion near the neck for tool engagement purposes during welding.

A method for making the connector broadly comprises the steps of providing a cylindrical copper blank and a cylindrical aluminum blank, impact extruding the cylindrical aluminum blank to simultaneously form the neck, the wire receiving opening and the internal and external bosses, heat treating the preformed aluminum blank, cleaning those faces of the two blanks which are to be welded, welding the two blanks together in a solid state bond as by an inertia welding process while gripping the preformed aluminum blank by its external boss and internal tool engaging recess means, removing flash from the weld while gripping the preformed connector by its internal tool engaging recess means, and performing successive machining operations on the preformed connector to provide a finished connector as it is successively rotated to desired positions by an indexing means while gripping the internal tool engaging recess means as to enable accurate orientation of the preformed connector with respect to tools employed during machining.

9 Claims, 11 Drawing Figures

BIMETALLIC ELECTRICAL CONNECTOR AND METHOD FOR MAKING THE SAME

BACKGROUND OF THE INVENTION

1. Field of Use

This invention relates generally to one-piece bimetallic electrical connectors used with electric terminators and to methods for making such connectors.

The connector comprises a copper portion and an aluminum portion joined in a solid state bond and having an axial wire receiving opening in the aluminum portion and having electrical connection means, such as a threaded hole, in the copper portion. Tooling and indexing bosses and tool engaging recess means are integrally formed on the exterior and interior of the aluminum portion.

The method generally comprises the steps of impact extruding an aluminum blank to simultaneously form a neck of reduced diameter, the wire receiving opening and the exterior boss and interior tool engaging recess means to provide a preformed aluminum blank, heat treating the preformed aluminum blank, joining the preformed aluminum blank and a copper blank in a solid state bond by an inertia welding process while employing the external boss and internal tool engaging recess means, and performing subsequent machining steps requiring axial reorientation of the preformed connector while employing the internal tool engaging recess means for indexing purposes.

2. Description of the Prior Art

One-piece bimetallic electrical connectors of various types are used in electrical systems to temporarily or permanently connect an electrical conductor made of one type of metal to another electrical conductor made of a dissimilar metal. U.S. Pat. Nos. 3,876,280 and 3,916,518, which are assigned the same assignee as the present application, disclose one-piece bimetallic electrical connectors and methods for making the same wherein an aluminum portion and a copper portion are joined together entirely across a common interface in a solid state bond effected by a process of inertia welding. The aluminum portion of the connector includes wire connection means in the form of a wire receiving first opening extending axially inwardly from an end face of the aluminum portion of the body and the copper portion of the connector includes connection means in the form of a threaded opening extending inwardly of a side of the copper portion of the body. In the aforementioned patents, the aluminum and copper portions are formed of solid blanks which are welded, and subsequent machining operations are performed to provide the holes therein.

In some one-piece bimetallic connectors of the aforesaid character it is desirable that the copper portion be of smaller diameter than the aluminum portion. However, this poses serious manufacturing problems, especially in the case of relatively small connectors. For example, it is important that the interface between the dissimilar metals be properly located so that a proper solid state bond will result, so that the aluminum portion will not be deformed during the welding process, and so that unnecessary machining operations will not be required in order to remove the welding flash. It is also important that the two sections of dissimilar metals be gripped during the inertia welding process in such a manner and by such means so as to prevent damaging, deforming, or defacing of either of the two portions being joined. It is also important to be able to reorient and accurately position or index the preformed connector about its axis with respect to various machine tools during the final stages of manufacture so that flat surfaces, holes, and threads can be provided in the copper section of the connector, without defacing the exterior of the connector and without causing rupture or collapse of the relatively weak walls surrounding the wire receiving opening in the aluminum portion of the connector. It is also necessary from the standpoint of mass production and cost reduction to carry out the manufacturing steps of the connector in the simplest manner possible and without the need to perform additional machining operations to correct defects introduced at some previous step of manufacture.

SUMMARY OF THE INVENTION

In accordance with the present invention there is provided a one-piece bimetallic electrical connector for use, for example, in an electrical terminator for connecting a wire to a female terminal on an electrical device where, for example, the wire and terminal are made of dissimilar metals, such as aluminum and copper, respectively. The one-piece bimetallic connector which comprises two portions of dissimilar metals, such as aluminum and copper, welded together across their entire interface in a solid state bond, as by inertia welding. Electrical connection means are provided on each portion of said connector. Thus, the connector comprises a wire receiving opening extending axially inwardly into the free end of one portion to receive a wire and to define crimpable wall means. The connector also comprises an opening, preferably threaded, extending laterally inwardly of the other portion from a side thereof.

In a preferred embodiment of the invention, a one-piece bimetallic electrical connector comprises a cylindrical aluminum portion having a neck of reduced diameter extending therefrom and a cylindrical copper portion welded to the neck in a solid state bond. A wire receiving opening extends axially inwardly from the free end of the aluminum portion and electrical connection means, such as a threaded hole, are formed near the free end of the copper portion. Internal tool engaging recess means are provided within the opening in the aluminum portion for tool engagement purposes during welding and for accurately indexing the connector during other subsequent manufacturing operations such as machining and drilling of the threaded hole. External bosses are provided on the exterior of the aluminum portion near the neck for tool engagement purposes during welding.

A method for making the connector broadly comprises the steps of providing a cylindrical copper blank and a cylindrical aluminum blank, impact extruding the cylindrical aluminum blank to simultaneously form the neck, the wire receiving opening and the internal tool engaging recess means and external bosses, heat treating the preformed aluminum blank to a specified degree of hardness, cleaning those faces of the two blanks which are to be welded, welding the two blanks together in a solid state bond as by an inertia welding process while gripping the preformed aluminum blank by its external bosses and internal tool engaging recess means removing flash from the weld while gripping the preformed connector by its internal tool engaging recess means, and performing successive machining operations on the preformed connector to provide a finished connector as it is successively rotated to desired positions by an indexing means while gripping the internal tool engaging recess means as to enable accurate orientation of the preformed connector with respect to tools employed during machining. The foregoing method steps may be carried out discretely on or by means of separate machines or may be carried out on automated machinery comprising appropriate tools for performing the various method steps. Furthermore, certain of the steps may be performed in sequences differing from the above-described sequence.

The step of impact extrusion can be carried out on well-known, commercially available types of impact extrusion apparatus.

Inertia welding is a solid state welding process which is described in detail in U.S. Pat. No. 3,273,233, issued Sept. 20, 1966 to Oberle et al. for "Method of Bonding Metal Workpieces." Other aspects of inertia welding are disclosed in a publication entitled "Caterpillar's Inertia Welding Process" by T. L. Oberle et al. and identified as bulletin ME-20890-1 of Caterpillar Tractor Co., Peoria, Ill. The welding to provide a connector in accordance with the invention was performed on a Caterpillar Model No. 150 machine being sold and serviced by Production Technology, Inc., a subsidiary of the Caterpillar Tractor Co. located in Peoria, Ill.

A bimetallic connector in accordance with the invention has superior electrical conductivity and mechanical properties as compared to prior art connectors as is discussed in detail in the aforementioned U.S. Pat. Nos. 3,876,280 and 3,916,518.

As hereinafter explained in detail, the external boss is employed during the welding step and serves as a means whereby a die on the welding machine grips the aluminum blank prior to and during welding. The internal tool engaging recess means serves as a means whereby the aluminum blank can accommodate an expandable mandril after welding, which mandril holds the preformed connector during flash removal, a first machining operation such as milling, and during a second or subsequent machining operation such as hole drilling. The internal tool engaging recess means ensures that the preformed connector can be precisely rotated to exact desired positions by the expandable mandril to accommodate successive machining operations. The external boss and internal tool engaging recess means are so designed and located with respect to each other in the aluminum blank during impact extrusion that the end wall therebetween is of sufficient structural strength as to be able to withstand heavy forces during inertia welding. In the embodiment shown, the copper end of the connector is provided with flat surfaces and with a threaded opening extending between these flat surfaces. It is contemplated that the flat surfaces are formed while the preformed connector is held in one position and that the threaded opening be formed after the preformed connector has been rotated about its axis by means of the internal tool engaging recess means and accurately disposed in another position. Furthermore, it will be understood that the connector can be provided with connecting means other than a threaded opening, such as screw threads on the end of the connector. It will also be understood that various sequential indexing and positioning of the preformed connector may be required during the formation of such other connecting means.

Other objects and advantages of the invention will hereinafter appear.

DESCRIPTION OF A PREFERRED EMBODIMENT

Figure 2:
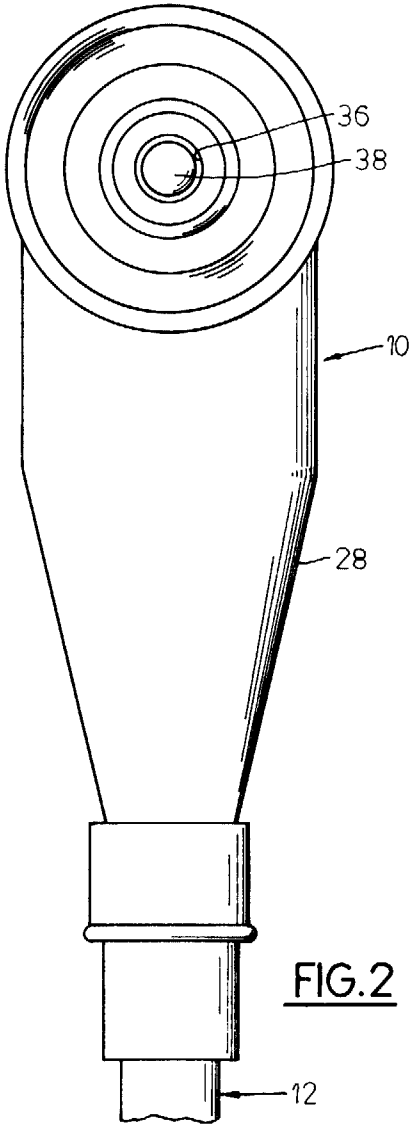
FIG. 2 is an end elevation view of the terminator taken on line 2—2 of FIG. 1.
Figure 1:
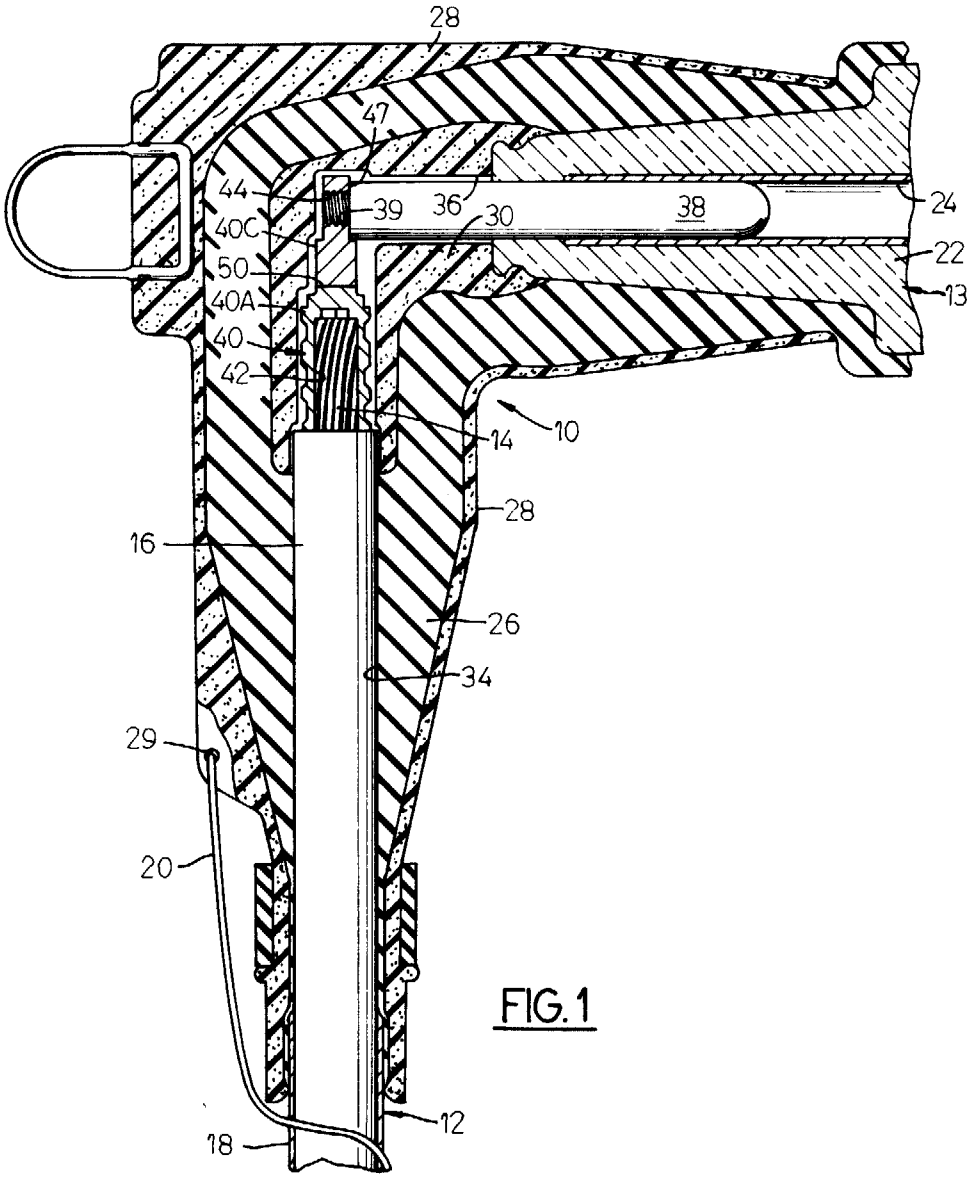
FIG. 1 is a side view in cross section of a terminator employing a connector in accordance with the present invention.
Figure 6:
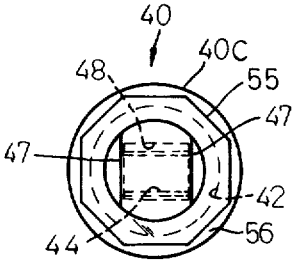
FIG. 6 is an end view of the top of the connector shown in FIG. 4.
Figure 3:
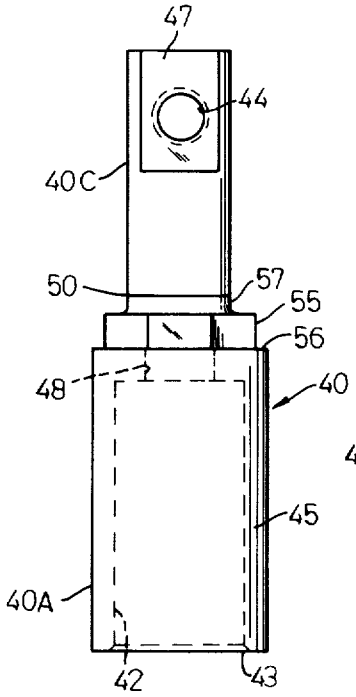
FIG. 3 is an enlarged front elevational view of the connector shown in FIG. 1.

Referring to FIGS. 1 and 2, the numeral 10 designates a terminator in accordance with the invention which is used to connect a flexible high voltage cable 12 to a receptacle 13 which, for example, may be mounted on a high voltage device or apparatus, such as a transformer, switch box, or the like, or even on the end of another cable. Cable 12 comprises an aluminum conductor 14 and cable insulation 16. Receptacle 13 comprises an insulating cone 22 in which a hollow electrically conductive copper terminal member 24 is mounted.

Terminator 10 is representative of a variety of commercially available terminators which may differ in size and in details as regards various features and options available.

Terminator 10 comprises a one-piece electrically conductive bimetallic cylindrically shaped connector 40, herinafter described in detail, having an electrically conductive cylindrically shaped copper probe 38. Probe 38 is engageable in and with receptacle 13. Connector 40 comprises an aluminum portion 40A for permanent crimp connection to the bare end of aluminum conductor 14 and a copper portion 40C forming part of roble 38. The portions 40A and 40C of connector 40 are welded together across their entire interface 50, as by the process of inertia welding, and in accordance with a method hereinafter described.

Aluminum portion 40A of connector 40 is provided with a cylindrical wire receiving opening 42 which extends axially inwardly of the connector from one end face 43 of the connector. After wire receiving opening 42 is formed, it is surrounded by an adjacent relatively thin cylindrical wall 45 of aluminum which is adapted to be crimped or swedged into tight engagement with the wire 14 inserted in opening 42.

Figure 4:
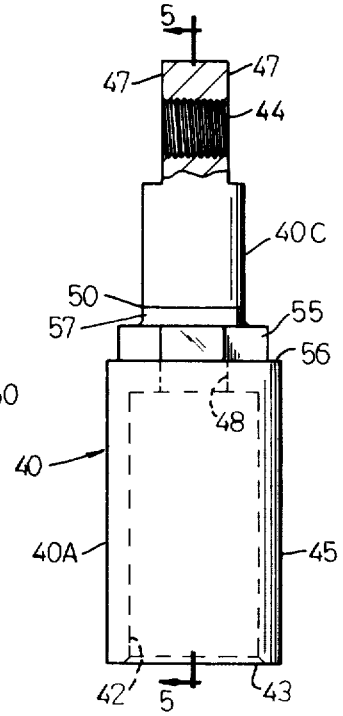
FIG. 4 is a side elevational view of the connector shown in FIG. 3.
Figure 5:
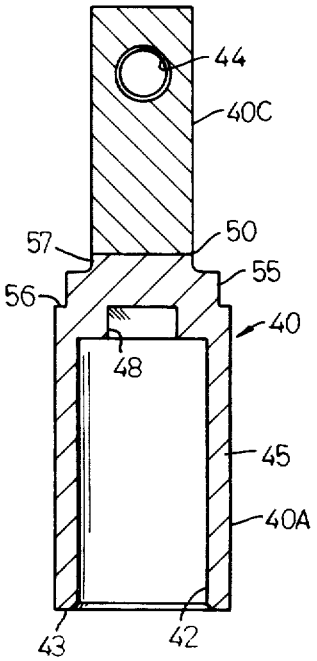
FIG. 5 is a cross-section view taken on line 5—5 of FIG. 4.
Figure 7:
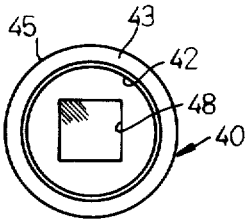
FIG. 7 is an end view of the bottom of the connector shown in FIG. 4.

Copper portion 40C of connector 40 is provided with an internally threaded screw receiving opening 44 which extends laterally inwardly of the connector from a side of the connector as FIG. 4 shows.

For field installation, a portion of the insulating 16 is stripped from an end of cable 12 to expose an end of conductor 14. The exposed end of conductor 14 of the cable is inserted into opening 42 in connector 40 and the wall 45 of the latter is crimped in place on the wire by means of a suitable conventional crimping tool. Subsequently, connector 40 is ready to be attached to or plugged into receptacle 13, as shown in FIG. 1.

The connector 40 shown in FIGS. 1 and 3 through 7 may, for example, be on the order of 4 1/6 inches long and 1 3/16 inches in outside diameter. Hole 42 therein may be on the order of 1⅞ inches deep and ⅞ inch in diameter. Hole 44 may be centered inwardly from the connector end about 7/16 inch and may be about 0.330 of an inch in diameter prior to provision of internal screw threads therein. However, connectors of other sizes and having dimensions other than specified are within the scope of the invention.

Wire receiving opening 42 extends axially inwardly from the free end of the aluminum portion 40A and internal tool engaging indexing means 48 are provided within the opening 42 for use during welding and other manufacturing operations such as machining the flats 47, rotating the preformed connector, and drilling to provide hole 44. External tool engaging bosses 55 are provided on the aluminum portion 40A at the shoulder 56 adjacent the probe section 57 of reduced diameter to hold the aluminum portion 40A prior to and during inertia welding.

The internal tool engaging recess means 48 take the form of flat surfaces arranged around the innermost end of opening 42 in the form of a four-sided figure. The external bosses 55 take the form of flat surfaces arranged around the outer surface of portion 40A adjacent shoulder 56 in the form of an eight-sided figure, such as the head of a bolt.

Figure 8:
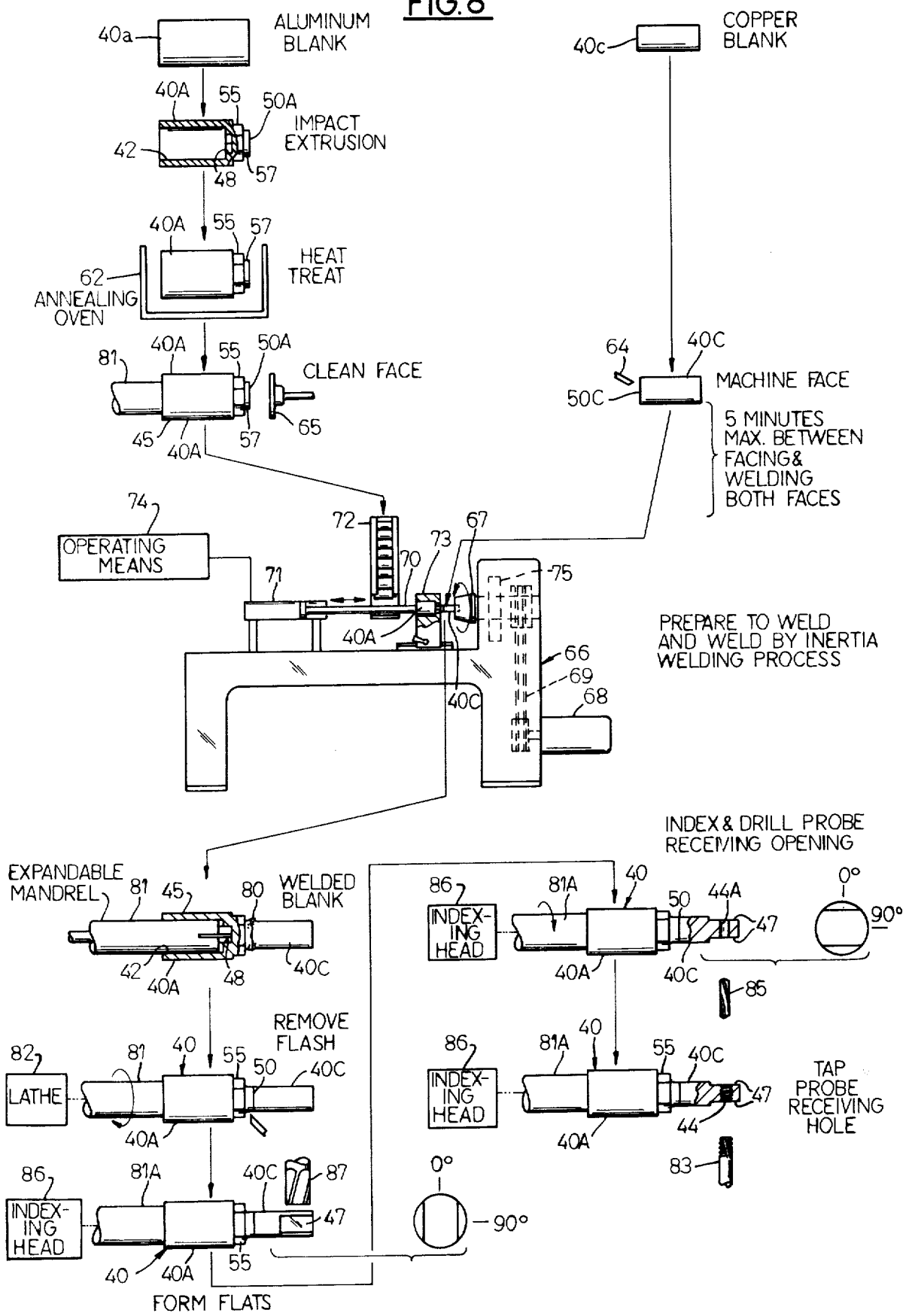
FIG. 8 is a flow chart or schematic diagram showing one preferred series of method or process steps for making a connector in accordance with the invention.
Figure 9:
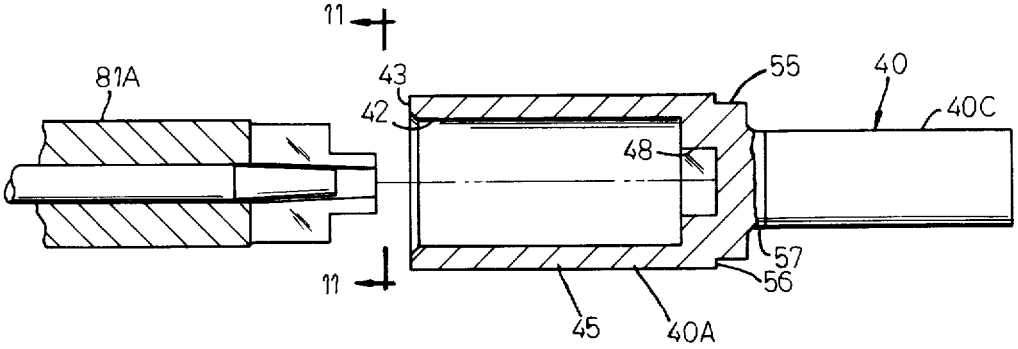
FIG. 9 is a cross-section view showing the connector and the expandable mandril prior to insertion of the latter.
Figure 10:
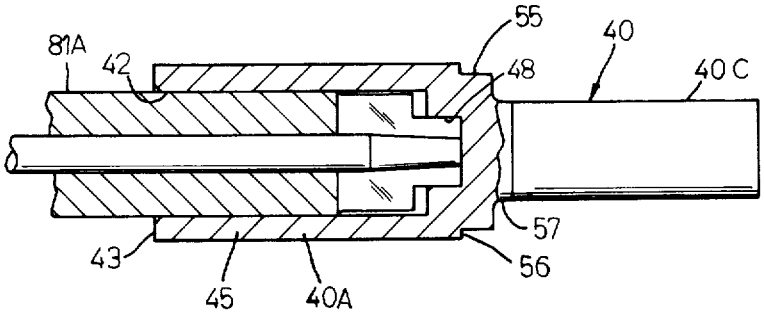
FIG. 10 is a cross-section view showing the connector and the expandable mandril after insertion of the latter.
Figure 11:
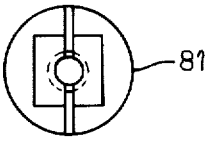
FIG. 11 is an end view of the expandable mandril shown in FIGS. 9 and 10.

FIG. 8 is a flow chart or diagram showing one preferred series of method or process steps in accordance with the invention for providing a connector 40 in accordance with the invention. Certain of the method steps depicted and described may be carried out in a different order than specified, as hereinafter explained.

In carrying out the method in accordance with the invention to provide a connector such as 40 of the aforedescribed size and dimensions, it has been discovered that it is desirable to start with a cylindrical aluminum blank **40*a* and a cylindrical copper blank 40*c*, such as shown in FIG. 8, with the aluminum blank 40 being of substantially larger diameter than the copper. All materials, dimensions, temperatures, pressures and other physical data and parameters hereinafter mentioned, are to be understood to apply to a connector 40** of the size hereinbefore described, unless otherwise noted, and may or may not apply to connectors of another size.

Copper blank **40*c* is preferably fabricated either of OFHC (Oxygen Free High Conductivity) 99.99% pure copper or of ETP (Electrolytec Tough Pitch) 99.9% pure copper. However, copper of lower purity or conductivity or copper alloys could be employed. Copper blank 40*c*** may be purchased as cylindrical bar stock or formed (as by forging, impact extrusion, rough machining, casting or sintering from powdered metal) and cut to proper length.

Aluminum blank **40*a*** is fabricated either of 99.0% or higher purity aluminum, such as EC or No. 1,000 series aluminum, or of lower percentage aluminum, such as No. 5,000 or No. 6,000 series aluminum. These standards are known in the industry and may be found in the January 1972, Third Edition of The Aluminum Association Standards.

Aluminum blank **40*a* is subjected to an impact extrusion process on a conventional impact extruding machine to shape blank 40*a* into a component having the general configuration of the portion 40A shown in FIGS. 3 through 7 wherein wire receiving opening 42 exists, wherein the internal tool engaging recess means 48 are formed, wherein the external bosses 55 are formed and wherein a small projection 57 at the end of portion 40A exists. Projection 57 is on the order of 1/16 inch in diameter larger than the diameter of copper blank 40*c*** to facilitate welding thereto by providing a large enough mating surface and a proper amount of aluminum flash, which flash is subsequently removed.

Aluminum blank **40*a* is heat treated, as in an annealing oven 62, to provide a specified degree of hardness so that all aluminum blanks in the same batch or production run are of a uniform degree of hardness. Typically, blank 40*a*** is annealed at 800° F. for 3 hours, followed by a controlled 50° F per hour drop in temperature over an additional 9 hour interval. This normally results in a hardness level of approximately 30–50 $R_H$.

In preparation for welding, the copper blank surface 50C which is to be welded is machine cleaned or finished, as by a cutting or facing tool 64 of a lath, to square it and to remove dirt, oxides and other foreign materials. Surface 50C of copper blank **40*c* is finished to approximately 90RMS. Finished surface 50C must be kept absolutely clean after finishing and prior to welding and make no physical contact with other materials or surfaces, including human hands. The time interval between cleaning surface 50C and welding should not exceed approximately 5 minutes so that undesirable films do not form or redeposit on finished surface 50C.**

In preparation for welding, the aluminum blank 40A is supported on a mandril 81 which extends into axial hole 42 and engages the internal bosses 48 and surface 50A which is to be welded is subjected to a cleaning treatment or finishing, as by abrasive means such as a disc sander wheel 65, to remove dirt, oxides and other foreign materials, but need not be machined as on a lathe. Like surface 50C, surface 50A must be kept absolutely clean after the cleaning treatment or finishing and prior to welding and, again, the time interval between cleaning and welding should not exceed approximately 5 minutes so as to avoid reformation and redeposit of undesirable films or coatings which would inhibit the welding process or result in the possible formation of gas-formed voids or intermetallic compounds.

As FIG. 8 schematically shows, welding of the blanks **40*a* and 40*c* is typically carried out on an inertia welding machine 66 of a type and in accordance with a method described in U.S. Pat. No. 3,273,233 hereinbefore referred to. Generally considered, inertia welding machine 66 comprises a linearly movable rotatable chuck, spindle or fixture 67 driven by an electric motor 68 by means of a belt drive 69. A flywheel 75 is attached to and drives chuck 67, as hereinafter explained. Welding machine 66 further comprises a non-rotatable linearly movable chuck or fixture 70 reciprocably movable by means of a drive means or element 71, such as a pneumatic cylinder, for receiving the preformed aluminum blanks 40A from a magazine 72 and inserting them into a holding die 73. Operating means 74 are provided to effect synchronized operation of cylinder 71 with respect to rotatable chuck 67. As will be understood, die 73 moves linearly with member 70 and means (not shown) are provided to release the preformed connector 40 from chuck 67 and die 73** after welding.

In the embodiment shown, copper blank 40c is mounted in rotatable chuck 67 and aluminum blank 40A is mounted in linearly movable chuck 70, with the surfaces 50C and 50A opposite each other. The aluminum blank 40A must be placed in its holding die 73 so that not more than approximately one-sixteenth inch of neck 57 projects from the die. Furthermore, no rotational slippage of either blank in its fixture is permitted during any phase of the welding cycle. Rotation of aluminum blank 40A is prevented by the coaction between die 73 and the external bosses 55 and between the fixture 70 and the internal bosses 48.

The internal tool engaging recess means 48 facilitate advancement of aluminum blank 40A during welding and also ensures that the aluminum blank will be properly reorientated for insertion in the die 73. As FIG. 8 shows, the cooperative action of both the internal tool engaging recess means 48 with the fixture 70 and the external bosses 55 with the die 73 absolutely prevent deformation of the thin wall at the closed end of aluminum blank 40A. The internal tool engaging recess means 48 and the external bosses 55 bear the brunt of the thrust and torque loads during welding. As will be noted, the external bosses 55 are disclosed herein as being employed only during the welding step.

Inertia welding machine 66 with the blanks 40A and 40c in place thereon operates as follows to carry out the inertia welding process whereby the blanks are welded together across the entire interface 50 between the surfaces 50A and 50C, respectively. In the inertia welding process, the flywheel 75 is used to control the process. Sufficient inertia energy from motor 68 is stored in rotating flywheel 75 which is coupled with and rotates blank 40c to bond the faces of 50A and 50C of the blanks 40A and 40c, respectively. This inertial energy is on the order of 2,460 foot pounds. The surface 50C rotates at a speed of about 250 feet per minute. Pressure is applied by drive means 71 to move aluminum blank 40A and to force surface 50C of copper blank 40c into rubbing contact with surface 50A of aluminum blank 40A. An axial load pressure on the order of 22,800 psi is required. Rotational rubbing contact between the surfaces 50A and 50C is continued to heat the surfaces to plastic condition and a bondable temperature at the applied pressure until the surfaces bond and the stored energy of flywheel 75 is expended. The duration of such rotational rubbing contact between the surfaces 50A and 50C is predetermined by the amount of energy stored in flywheel 75. The continued rotation after the beginning of bonding serves to refine the structure of the weld and to force out any entrapped voids, oxides and other defects from the weld. Thus, the inertial weld results in an interface 50 wherein no intermetallic compounds are present to increase the electrical resistance in or through the weld or physically weaken the mechanical bond between the joined pieces. In the course of welding material upset or loss, in the form of flash 80, as shown in FIG. 8, occurs only on aluminum blank 40A and amounts to approximately ¼ inch of the length of the blank. As FIG. 8 further shows, the weld results in a one-piece integrally welded bimetallic connector 40 wherein full electrical and mechanical contact exists across and between the portions 40A and 40C at and near their interface 50. An uninterrupted, electrically conductive path is obtained, as compared to prior art connectors wherein two dissimilar members are mechanically connected and have only partially contacting surfaces. A connector 40 in accordance with the invention, if subjected to tensile and bend tests, will exhibit a failure which will occur only in the weaker of the two materials and not in the weld region.

As FIG. 8 also shows, after welding, the joined blanks of preformed connector 40 are subject to treatment for removal of the aluminum flash and to provide a connector of finished diameter. This step is carried out by inserting an expandable mandril 81 of a lathe 82 into hole 42 of connector 40 and machining on lathe 82. The next steps are carried out when connector 40 is transferred to and supported on another expandable mandril 81A which engages the internal tool engaging recess means 48.

FIGS. 8, 9, 10, and 11 show that an indexing head 86 which controls mandril 81A orientates and maintains connector 40 in a position (0° position) wherein, for example, a mill cutter 87 shapes the flat faces 47. Thereafter, as FIG. 8 shows, indexing head 86 effects axial rotation of mandril 81A and the connector 40 thereon to a position, such as 90° from the 0° position, wherein the hole 44A is drilled by means of a drill 85 and the hole 44A is tapped as by a tap 83 to provide hole 44.

FIG. 8 shows that hole 44A is cross-drilled by means of drill 85, and that threads in hole 44A are formed by means of tap 83. It is necessary that the two flats 47 be accurately cut so that they are parallel to each other and accurately aligned with the axis of connector 40. It is also necessary, for example, that the axis of hole 44 be disposed at an exact 90° angle with respect to the flats 47. This is readily accomplished in accordance with the present invention because the internal tool engaging recess means 48 which engage the mandril 81A ensure that, if the mandril is accurately positioned with respect to the tools, then the connector 40 will also be accurately indexed with respect to the tools.

The foregoing method steps can be carried out discretely on or by means of separate tools or machines in the various orders described or can be carried out on a turret type machine or other types of automated machinery comprising or associated with appropriate tools or devices for performing the various steps.

I claim:

1. In a one-piece bimetallic electrical connector comprising two portions of dissimilar metals joined together in a solid state bond, electrical connecting means on each portion of said connector, said electrical connecting means on one portion comprising a wire receiving opening extending inwardly from one end of said connector for a predetermined distance to a predetermined point, an interior tool engaging means for tooling purposes provided on said one portion of said connector in said wire receiving opening and an exterior boss for tooling purposes provided on said one portion of said connector.

2. A connector according to claim 1 wherein said exterior boss is located between said predetermined point and the other portion of said connector.

3. In a one-piece bimetallic electical connector comprising an aluminum portion and a copper portion joined together in a solid state bond, electrical connecting means on each portion of said connector, said electrical connecting means on said aluminum portion comprising a wire receiving opening extending inwardly from one end of said connector for a predetermined distance to a predetermined point, an interior tool engaging means for tooling purposes on said aluminum portion in said wire receiving opening, and an exterior boss for tooling purposes provided on said aluminum portion between said predetermined point and said copper portion.

4. A connector according to claim 3 wherein said interior tool engaging means is located near said predetermined point.

5. A connector according to claim 4 wherein said copper portion is of smaller diameter than said aluminum portion and wherein said aluminum portion has a neck of reduced diameter across which it joins said copper portion.

6. A connector according to claim 5 wherein said electrical connecting means on said copper portion comprises screw threads.

7. A connector according to claim 6 wherein said screw threads are located in a hole extending transversely of the axis of said connector.

8. A connector according to claim 3 wherein said electrical connecting means on said copper portion comprises screw threads.

9. A connector according to claim 8 wherein said screw threads are located in a hole extending transversely of the axis of said connector.

* * * * *